US009343213B2

(12) United States Patent
Peng et al.

(10) Patent No.: US 9,343,213 B2
(45) Date of Patent: May 17, 2016

(54) COMPONENT FOR FIXING CURVATURE OF FLEXIBLE DEVICE AND DEFORMATION AND FIXING CURVATURE METHOD

(71) Applicant: Industrial Technology Research Institute, Hsinchu (TW)

(72) Inventors: Yi-Cheng Peng, Taoyuan County (TW); Yi-Ming Zhu, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/162,768

(22) Filed: Jan. 24, 2014

(65) Prior Publication Data

US 2014/0210577 A1 Jul. 31, 2014

Related U.S. Application Data

(60) Provisional application No. 61/756,477, filed on Jan. 25, 2013.

(51) Int. Cl.
*H01F 7/20* (2006.01)
*H01F 7/02* (2006.01)

(52) U.S. Cl.
CPC ..... *H01F 7/0215* (2013.01)

(58) Field of Classification Search
CPC ..... H01F 7/0284
USPC ..... 335/285
See application file for complete search history.

(56) References Cited

U.S. PATENT DOCUMENTS 2,627,097 A * 2/1953 Ellis ..... A44B 19/16 174/119 C
2,959,832 A * 11/1960 Baermann ..... A45C 13/1069 174/110 A
3,111,735 A * 11/1963 Ellis ..... A44B 19/16 24/400
4,577,174 A * 3/1986 Lemmer ..... H01F 3/02 335/245
6,210,772 B1 * 4/2001 Ackermann ..... B60J 11/06 150/166
6,366,440 B1 * 4/2002 Kung ..... E05C 19/16 361/147
7,165,453 B2 1/2007 Flora et al.
7,568,566 B2 * 8/2009 D'Ambrosio ..... A45C 13/1069 190/119
7,636,085 B2 12/2009 Yang
8,138,869 B1 * 3/2012 Lauder ..... G06F 1/1613 24/303

(Continued)

FOREIGN PATENT DOCUMENTS

CN 101852932 10/2010
TW M264528 5/2005

(Continued)

OTHER PUBLICATIONS

Tetsuro Nakano, et al., "Magnetic actuation type low cost polymer MEMS mirror fabricated by photolithography and wet etching processes," IEEE/LEOS International Conference on Optical MEMS and Nanophotonics, 2009, pp. 9-10.

(Continued)

*Primary Examiner* — Alexander Talpalatski
(74) *Attorney, Agent, or Firm* — Jianq Chyun IP Offic

(57) ABSTRACT

Provided is a component for fixing the curvature of a flexible device. The component includes a permanent magnet substrate and a magnetic substrate connect to the permanent magnet substrate. The permanent magnet substrate includes a first permanent magnet structure, and the magnetic substrate includes an electromagnet structure, a second permanent magnet structure, or a ferromagnetic material structure.

23 Claims, 22 Drawing Sheets

(56) References Cited

U.S. PATENT DOCUMENTS

| | | | | |
|---|---|---|---|---|
| 8,151,501 | B2 | 4/2012 | Bemelmans et al. | |
| 8,167,628 | B2 | 5/2012 | Yoon et al. | |
| 8,242,868 | B2 * | 8/2012 | Lauder | G06F 1/1647 24/303 |
| 2006/0238288 | A1 * | 10/2006 | Watanabe | H01F 41/0233 336/212 |
| 2008/0278269 | A1 * | 11/2008 | Ramirez | E05C 19/16 335/205 |
| 2009/0103261 | A1 * | 4/2009 | Shih | E05C 19/16 361/679.58 |
| 2010/0075717 | A1 | 3/2010 | Ou | |
| 2012/0044031 | A1 * | 2/2012 | Ninomiya | H01F 7/0263 335/219 |
| 2012/0068797 | A1 * | 3/2012 | Lauder | G06F 1/1647 335/285 |
| 2012/0229235 | A1 | 9/2012 | Fullerton et al. | |
| 2013/0216740 | A1 | 8/2013 | Russell-Clarke et al. | |
| 2013/0300677 | A1 | 11/2013 | Kim et al. | |

FOREIGN PATENT DOCUMENTS

| | | |
|---|---|---|
| TW | M320822 | 10/2007 |
| TW | 200919095 | 5/2009 |
| TW | 200947373 | 11/2009 |
| TW | M428394 | 5/2012 |

OTHER PUBLICATIONS

Hongyi Li, et al., "Output-Feedback-Based H∞ Control for Vehicle Suspension Systems With Control Delay," IEEE Transactions on Industrial Electronics, vol. 61, No. 1, Jan. 2014, pp. 436-446.

Avishek Ghosh, et al., "Design and simulation of MEMS based piezoresistive pressure sensor for enhanced sensitivity," ICEETS International Conference on Energy Efficient Technologies for Sustainability, 2013, pp. 918-923.

Cherrill M. Spencer, "Improving the Reliability of Particle Accelerator Magnets: Learning From Our Failures," IEEE Transactions on Applied Superconductivity, vol. 24, No. 3, Jun. 2014, pp. 0500405.

Umeda, N., et al., "Long-pulse beam acceleration of MeV-class H-ion beams for ITER NB accelerator," Review of Scientific Instruments, vol. 85, Issue.2, 2014, pp. 02B304-02B304-3.

Mosaddequr Rahman, et al., "An improved analytical method to design CMUTs with square diaphragms," IEEE Transactions on Ultrasonics, Ferroelectrics, and Frequency Control, vol. 60, No. 4, Apr. 2013, pp. 834-845.

Yi-Cheng Peng, et al., "Flexible Electronic Device," Unpublished TW application No. 103101154 , Filed on Jan. 13, 2014.

Yi-Cheng Peng, et al., "Flexible Electronic Device," Unpublished CN application No. 201410031861.6, Filed on Jan. 23, 2014.

Yi-Cheng Peng, et al., "Flexible Electronic Device," Unpublished U.S. Appl. No. 14/162,773 , filed Jan. 24, 2014.

Office Action of Taiwan Counterpart Application, issued on Feb. 1, 2016, p. 1-p. 13.

* cited by examiner

COMPONENT FOR FIXING CURVATURE OF FLEXIBLE DEVICE AND DEFORMATION AND FIXING CURVATURE METHOD

CROSS-REFERENCE TO RELATED APPLICATION

This application claims the priority benefits of provisional application Ser. No. 61/756,477, filed on Jan. 25, 2013. The entirety of the above-mentioned patent applications are hereby incorporated by reference herein and made a part of this specification.

TECHNICAL FIELD

The disclosure relates to a component for fixing the curvature of a flexible device and a deformation and fixing curvature method.

BACKGROUND

In recent years, the flat panel display has been trending toward being slim and light; however the current display cannot achieve both qualities in teens of portability and the amount of information displayed. To balance portability and the amount of information displayed, the development of a flexible or a rollable flexible display is important.

However, the curvature of a flexible electronic device formed by a flexible display needs to be fixed in certain operating modes, and the current hinged mechanism cannot meet the application need. The research involving the use of an electroactive polymer (EAP) as a fixing component also shows that the fixing component needs a continuous supply of power to maintain the curvature of the flexible device.

SUMMARY

One embodiment of the disclosure provides an adjustable component for fixing the curvature of a flexible device. The component includes a permanent magnet substrate and a magnetic substrate connects to the permanent magnet substrate. The permanent magnet substrate includes a first permanent magnet structure, and the magnetic substrate includes an electromagnet structure, a second permanent magnet structure, or a ferromagnetic material structure.

One embodiment of the disclosure also provides a manual deformation and fixing curvature method of the component above. The method includes pushing the component for fixing the curvature of a flexible device and detecting a force applied or an amount of deformation caused by the force applied. Whether the force applied or the amount of deformation is greater than a threshold value is determined, and if the force applied or the amount of deformation is greater than the threshold value, then the electromagnet structure in the magnetic substrate is driven to release the permanent magnet substrate and the magnetic substrate, and the step of detecting the force applied or the amount of deformation is repeated. If the force applied or the amount of deformation is not greater than the threshold value, then the driving of the electromagnet structure is stopped to lock the permanent magnet substrate and the magnetic substrate.

One embodiment of the disclosure further provides an automatic deformation and fixing curvature method of the component above. The method includes triggering the component for fixing the curvature of a flexible device, and driving the electromagnet structure in the magnetic substrate to release the permanent magnet substrate and the magnetic substrate and drive magnetic components through magnetic repulsion and attraction so as to occur dislocation displacement. Accordingly, the component above is deformed, and the electromagnet structure is then stopped to lock the permanent magnet substrate and the magnetic substrate.

One embodiment of the disclosure further provides an automatic deformation and fixing curvature method of the component above. The method includes triggering the component for fixing the curvature of a flexible device, detecting an amount of deformation of the component, and determining whether the amount of deformation is less than a threshold value. If the amount of deformation is less than the threshold value, then the electromagnet structure in the magnetic substrate is driven to release the permanent magnet substrate and the magnetic substrate, and the step of detecting the amount of deformation is repeated. If the amount of deformation is not less than the threshold value, then the driving of the electromagnet structure is stopped to lock the permanent magnet substrate and the magnetic substrate.

In order to make the disclosure more comprehensible, embodiments accompanied with figures are described in detail below.

DETAILED DESCRIPTION OF DISCLOSED EMBODIMENTS

Figure 1A:
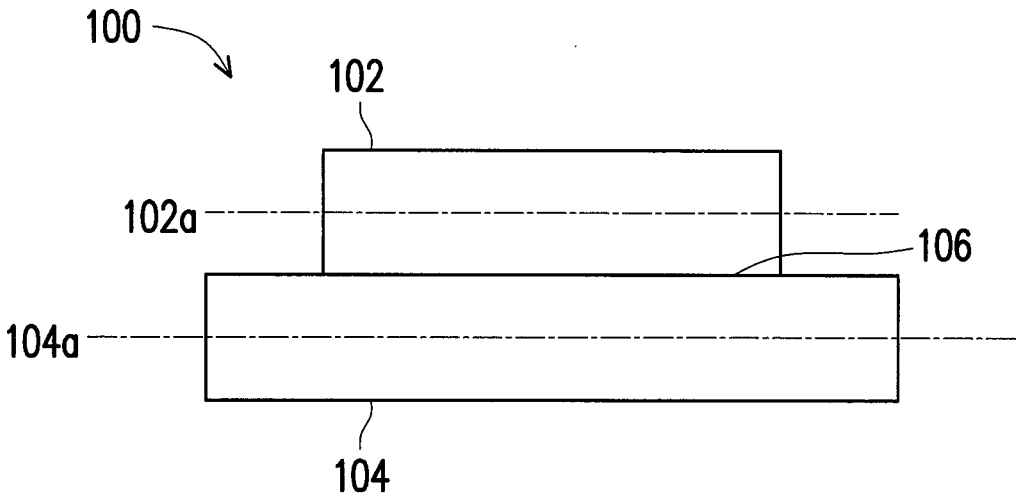
FIG. 1A to FIG. 1C are schematic diagrams of the working principle of a component for fixing the curvature of a flexible device of the disclosure.
Figure 1B:
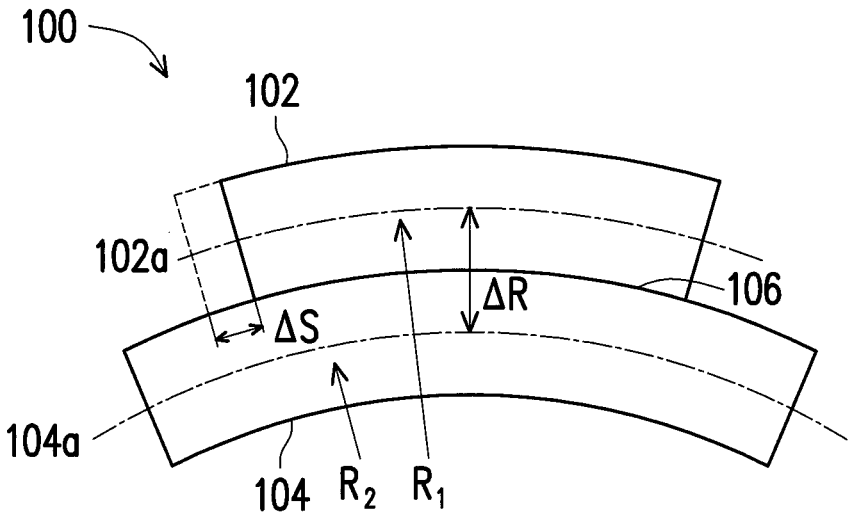
Figure 1C:
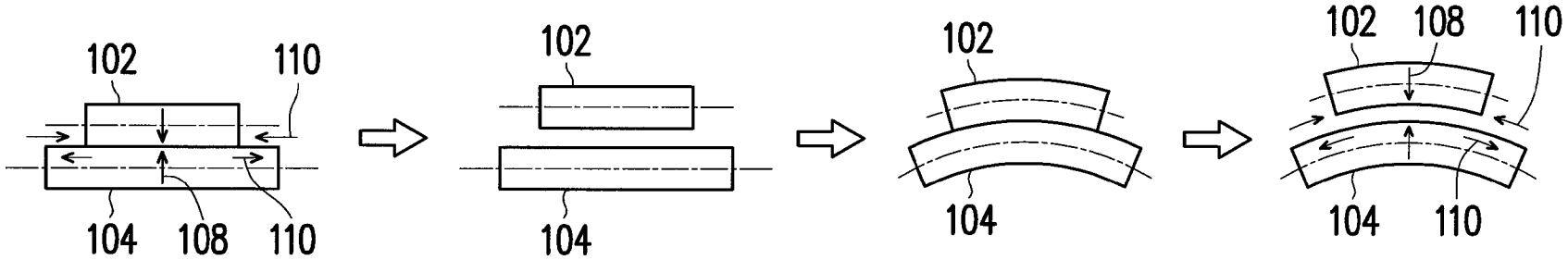

FIG. 1A to FIG. 1C are schematic diagrams of the working principle of a component for fixing the curvature of a flexible device of the disclosure.

In FIG. 1A, only one permanent magnet substrate 102 and one magnetic substrate 104 connect to the permanent magnet substrate 102 are shown for a component 100 for fixing the curvature of a flexible device. The two substrates 102 and 104 are both in a horizontal state at neutral axes 102*a* and 104*a* before the actuation of the neutral axes 102*a* and 104*a*, and a contact surface 106 of the two substrates 102 and 104 is also parallel to the neutral axes 102*a* and 104*a*.

Figure 1D:
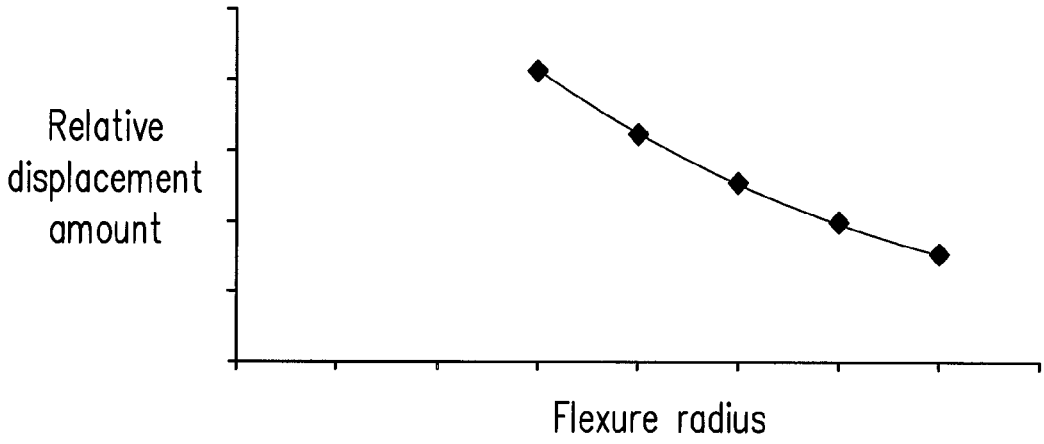
FIG. 1D and FIG. 1E are diagrams of the relationship between relative displacement amount and flexing radius/radius difference of the contact surfaces of two substrates of a component for fixing the curvature of a flexible device of one embodiment of the disclosure.
Figure 1E:
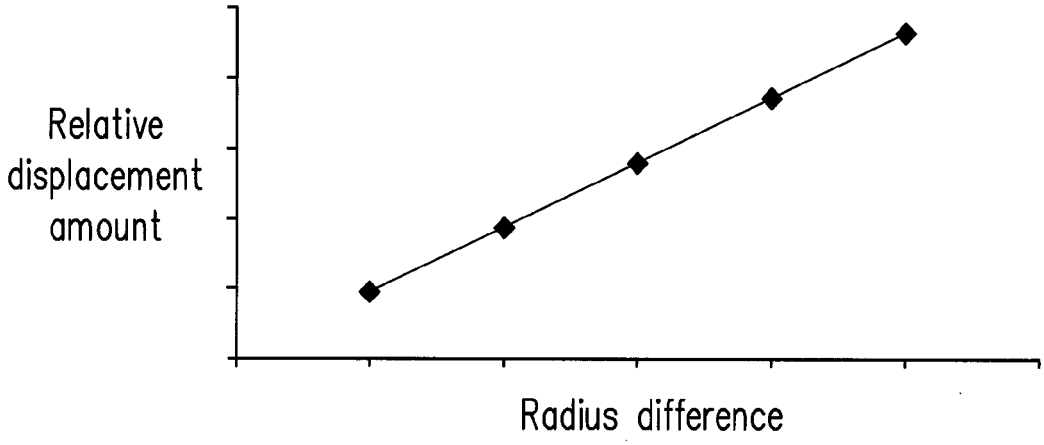

FIG. 1B shows the flexing of the permanent magnet substrate 102 and the magnetic substrate 104. In FIG. 1B, the relative displacement amount ($\Delta S$) of the contact surface 106 of the two substrates 102 and 104 respectively forms a mathematical relationship with the flexing radii ($R_1$ and $R_2$) thereof and the flexing radius difference ($\Delta R=R_1-R_2$), as shown in FIG. 1D and FIG. 1E.

Therefore, the curvature changed by flexing of the permanent magnet substrate 102 and the magnetic substrate 104 may be fixed by stopping the dislocation of the contact surface 106 during flexing. For instance, FIG. 1C shows that when the permanent magnet substrate 102 and the magnetic substrate 104 containing an electromagnet therein are not flexed, the permanent magnet substrate 102 and the magnetic substrate 104 are fixed by a vertical force 108 perpendicular to the tangent of the contact surface 106 and a stopping force 110 parallel to the tangent of the contact surface 106. Moreover, the permanent magnet substrate 102 and the magnetic substrate 104 may be deformed through dislocation displacement caused by magnetic repulsion and attraction. Then the curvature of the permanent magnet substrate 102 and the magnetic substrate 104 may be fixed through the vertical force 108 perpendicular to the tangent of the contact surface 106 and the stopping force 110 parallel to the tangent of the contact surface 106.

The working principle above may allow the disclosure to be applied to various suitable devices.

Figure 2:
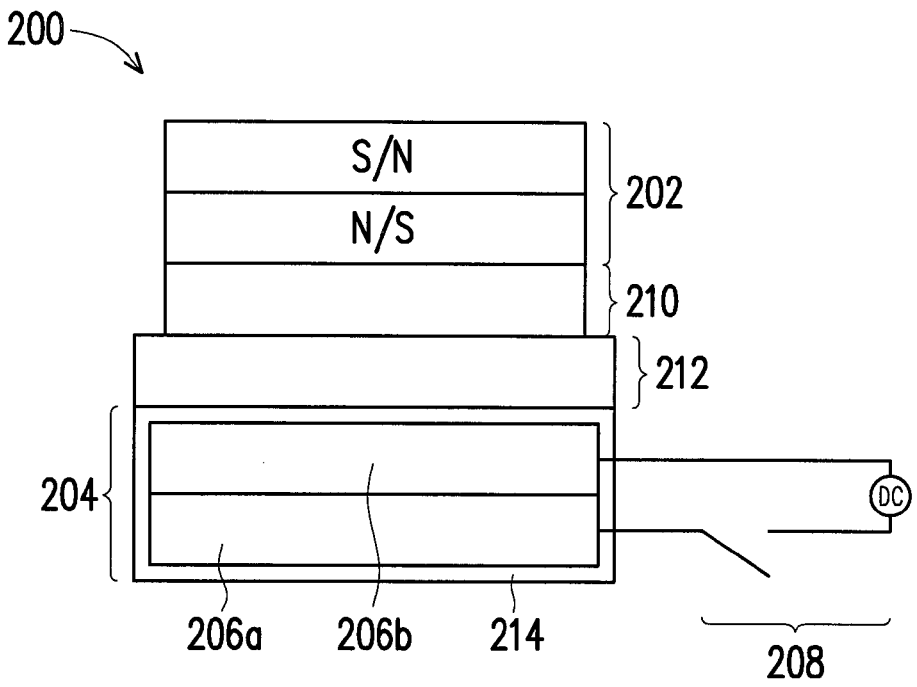
FIG. 2 is a schematic diagram of a component for fixing the curvature of a flexible device according to the first embodiment of the disclosure.

FIG. 2 is a schematic diagram of a component for fixing the curvature of a flexible device according to the first embodiment of the disclosure. In FIG. 2, a component 200 for fixing the curvature of a flexible device includes a permanent magnet substrate 202 and a magnetic substrate 204 connects to the permanent magnet substrate 202. The permanent magnet substrate 202 includes a first permanent magnet structure (S—N or N—S), and the rigidity thereof includes soft or rigid. In the present embodiment, the magnetic substrate 204 is an electromagnet structure 206*a-b*. However, the disclosure is not limited thereto. The magnetic substrate 204 may also include a second permanent magnet structure or a ferromagnetic material structure. When the magnetic substrate 204 is the electromagnet structure 206*a-b*, a driving circuit 208 is linked to the electromagnet structure 206*a-b* to lock or release the permanent magnet substrate 202 and the magnetic substrate 204.

Figure 3A:
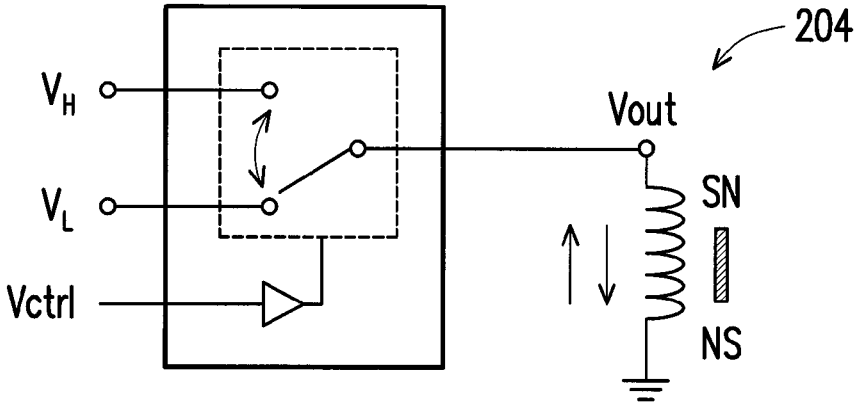
FIG. 3A is a magnetic pole control circuit diagram of a driving circuit driven by a bidirectional voltage.
Figure 3B:
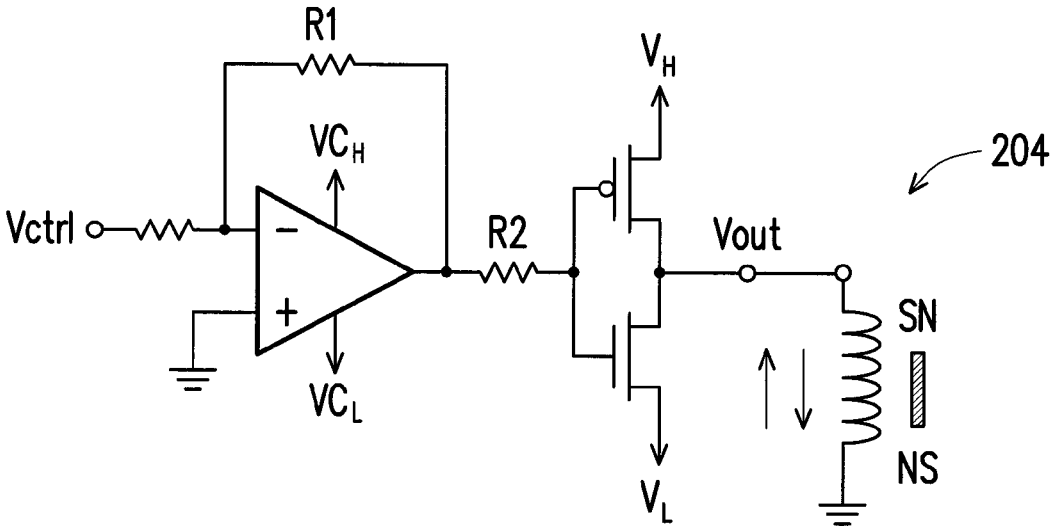
FIG. 3B is an embodiment of a voltage magnetic pole control circuit in FIG. 3A.

For instance, the driving circuit 208 may be undirectionally driven (polarity is not changed) or bidirectionally driven (polarity may be changed). FIG. 3A exemplarily shows a diagram of a magnetic pole control circuit driven by a bidirectional voltage. A specific embodiment of the magnetic pole control circuit may include a relay, an optocoupler, or a metal-oxide-semiconductor (MOS) switching circuit as shown in FIG. 3B. If a MOS switch of FIG. 3B is used for control, then the driving waveform diagram of the MOS switching circuit is as shown in FIG. 3C.

Figure 3C:
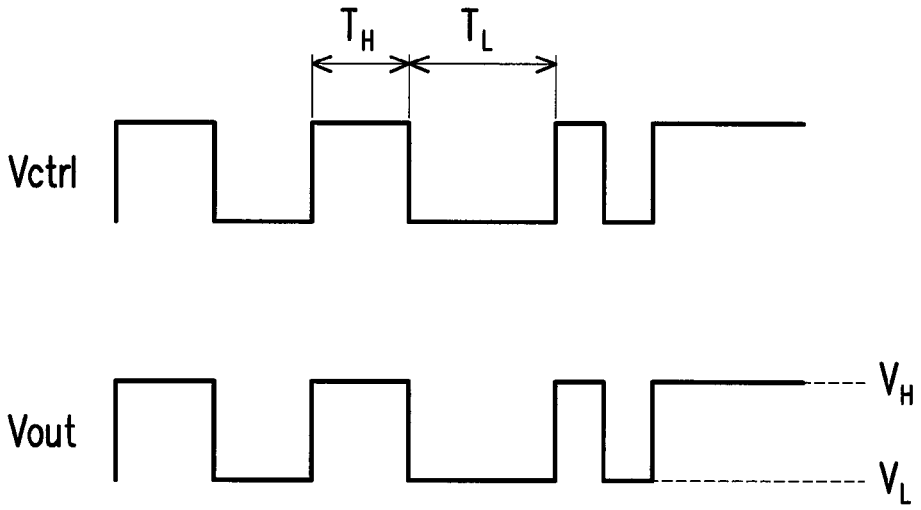
FIG. 3C is a driving waveform diagram of the voltage magnetic pole control circuit of FIG. 3B.

The driving voltage in FIG. 3C is not necessarily symmetrical. For instance, $VC_H$=8 volts, $VC_L$=−6 volts, $V_H$=5 volts, and $V_L$=−3 volts. Moreover, the time thereof at a high state and a low state may also not be the same. For instance, $T_H$=10 milliseconds and $T_L$=5 milliseconds, or $T_H$=10 milliseconds and $T_L$=10 milliseconds. Moreover, to reduce power consumption, all power sources may be 0 volts at the same time.

Figure 4A:
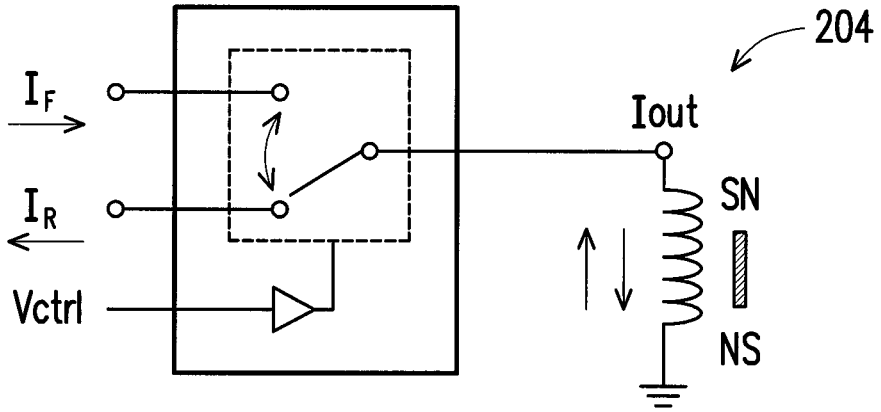
FIG. 4A is a diagram of a magnetic pole control circuit of a driving circuit driven by a bidirectional current.
Figure 4B:
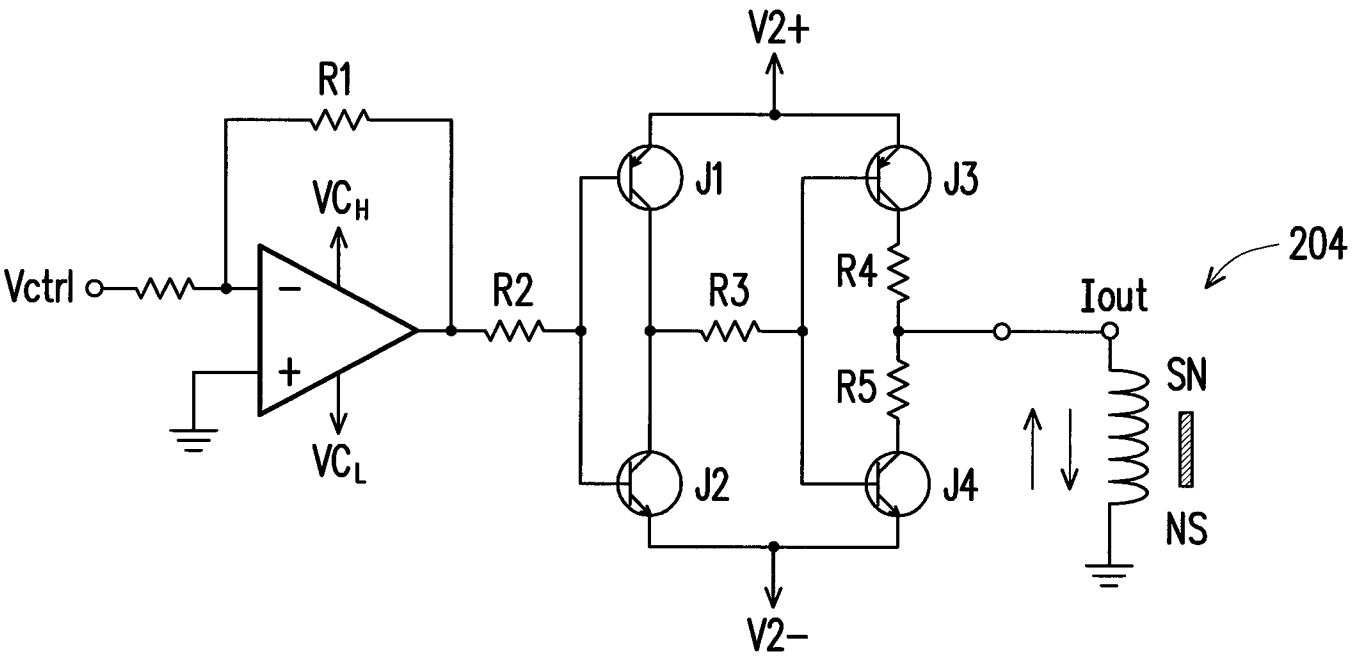
FIG. 4B is an embodiment of a current magnetic pole control circuit in FIG. 4A.

Moreover, the driving circuit 208 may also control by using the magnetic pole control circuit driven by a bidirectional current as shown in FIG. 4A. An embodiment may include a Darlington circuit as shown in FIG. 4B. If a Darlington circuit of FIG. 4B is used for control, then the driving waveform diagram is as shown in FIG. 4C.

Figure 4C:
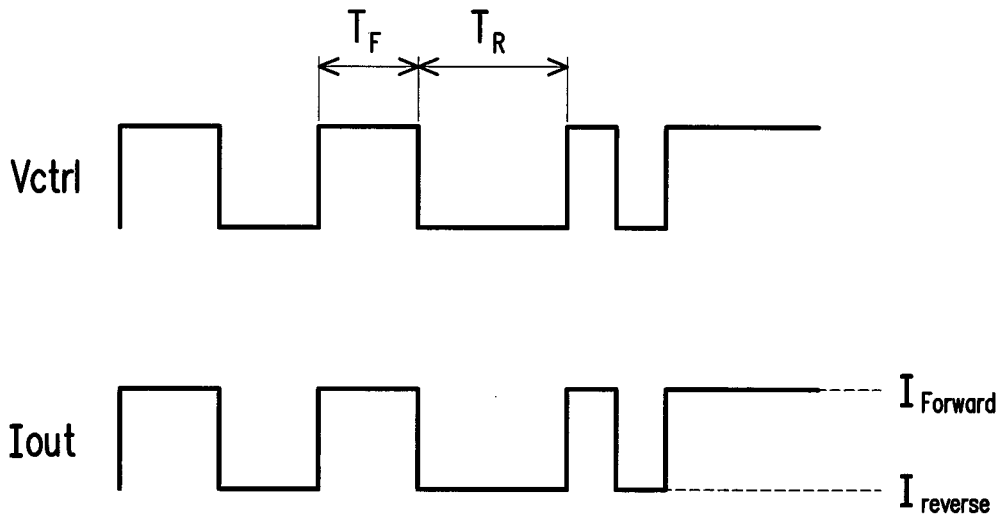
FIG. 4C is a driving waveform diagram of the current magnetic pole control circuit of FIG. 4B.

The driving current in FIG. 4C is not necessarily symmetrical, and the forward and reverse times of the current thereof may also not be symmetrical. Moreover, to reduce power consumption, all power sources may be 0 volts at the same time.

Figure 5A:
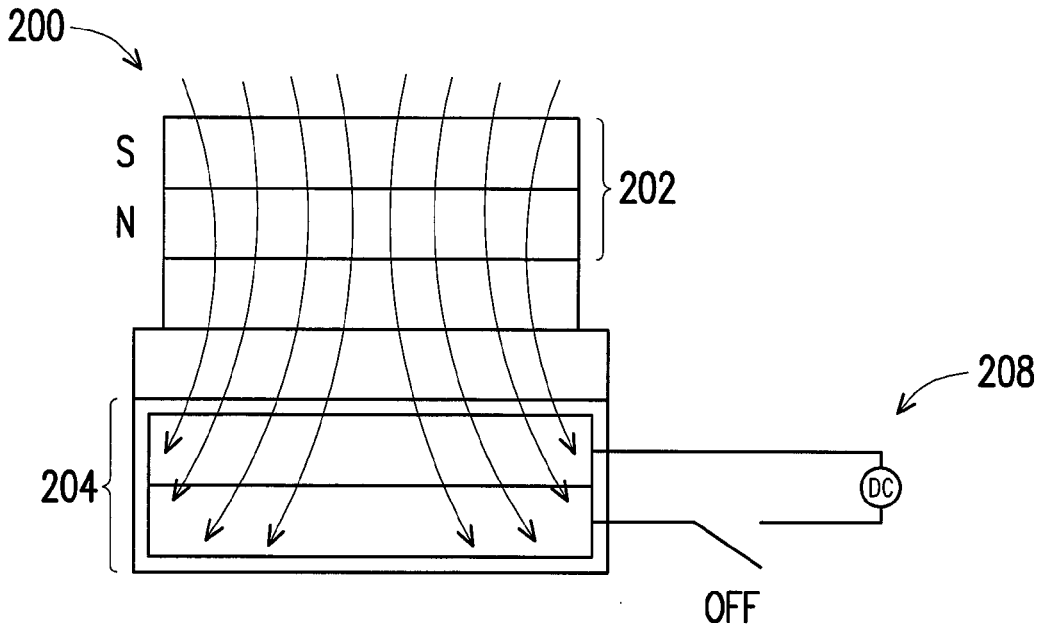
FIG. 5A to FIG. 5C are operation flowcharts of a component for fixing the curvature of the flexible device of FIG. 2.
Figure 5B:
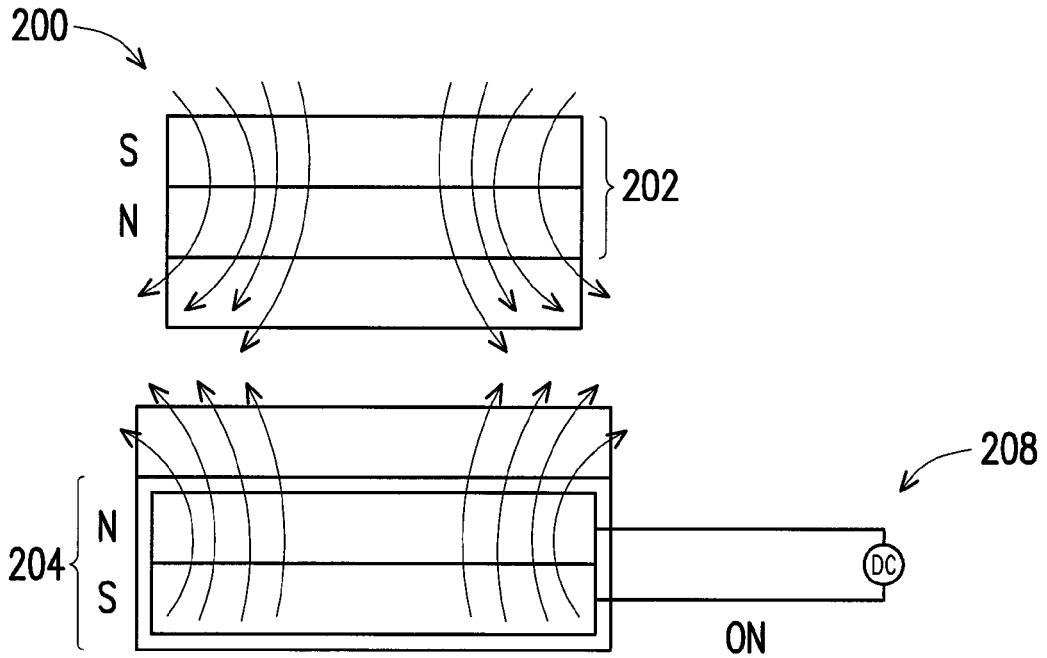
Figure 5C:
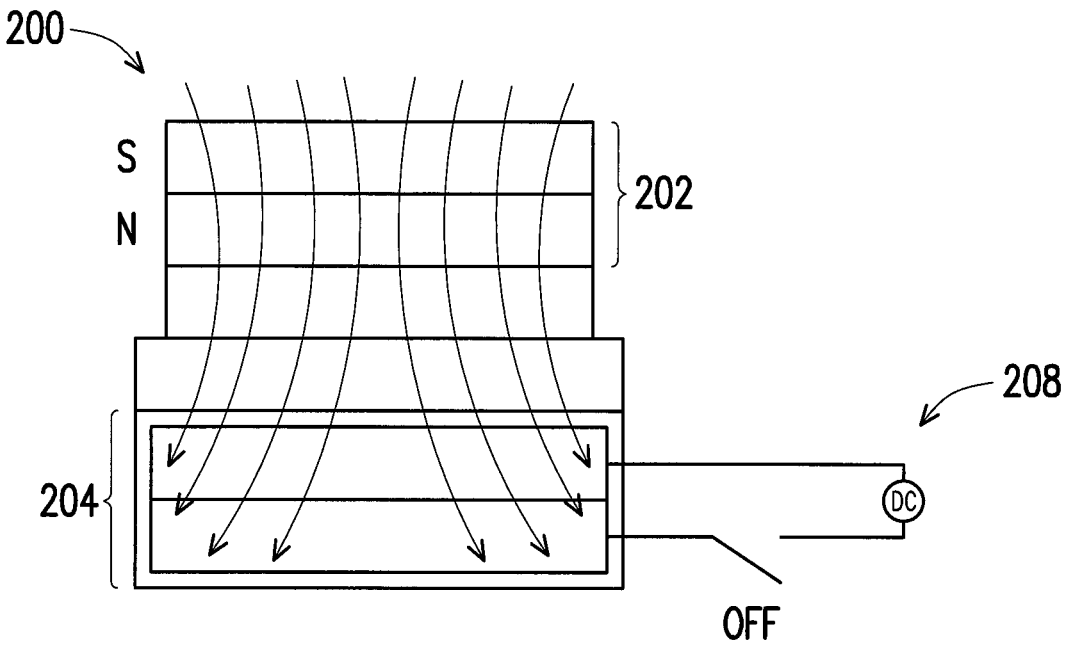

FIG. 5A to FIG. 5C are operation flowcharts of a component for fixing the curvature of a flexible device of FIG. 2. When the driving circuit 208 of the component 200 for fixing the curvature of a flexible device is not turned on, the permanent magnet substrate 202 is attached to the magnetic substrate 204 as shown in FIG. 5A, wherein the magnetic pole and the magnetic line of force are noted. When the driving circuit 208 is turned on, the permanent magnet substrate 202 repels the electromagnet in the magnetic substrate 204 and the permanent magnet substrate 202 and the magnetic substrate 204 become separated as shown in FIG. 5B. The permanent magnet substrate 202 and the magnetic substrate 204 may be flexed at this point to deform the permanent magnet substrate 202 and the magnetic substrate 204. Then, the driving circuit 208 is turned off such that the permanent magnet substrate 202 is attached to the magnetic substrate 204 as shown in FIG. 5C to achieve the effect of fixing without continuous power consumption.

Referring further to FIG. 2, in the present embodiment, the component 200 for fixing the curvature of a flexible device may further include a first contact layer 210 between the permanent magnet substrate 202 and the magnetic substrate 204 and disposed on the permanent magnet substrate 202, and a second contact layer 212 between the first contact layer 210 and the magnetic substrate 204 and disposed on the magnetic substrate 204. The first and second contact layers 210 and 212 basically fix the permanent magnet substrate 202 and the magnetic substrate 204 through a mechanical force or friction, as described in detail below. Moreover, the magnetic substrate 204 may also include a flexible encapsulation layer 214 encapsulating the magnetic components such as the electromagnet structure 206*a-b*, the second permanent magnet structure (not shown), or the ferromagnetic material structure (not shown).

Although the interface between the first and second contact layers 210 and 212 shown in FIG. 2 is depicted as a flat surface, the surface of the first contact layer 210 contacted to the second contact layer 212 may be a roughened surface, a zigzag surface, a three-dimensional pattern, or an array thereof. The surface of the second contact layer 212 contacted to the first contact layer 210 may also be a roughened surface, a zigzag surface, a three-dimensional pattern, or an array thereof. For instance, FIG. 6A to FIG. 6D show cross-sectional schematic diagrams of four different contact surface configurations. The contact surfaces between the first and second contact layers 210 and 212 may be engaged with each other to prevent sliding of the permanent magnet substrate 202 and the magnetic substrate 204.

Figure 6A:
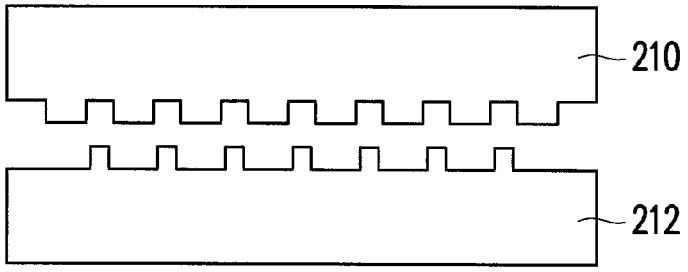
FIG. 6A to FIG. 6D are cross-sectional schematic diagrams of four different contact surface configurations.
Figure 6B:
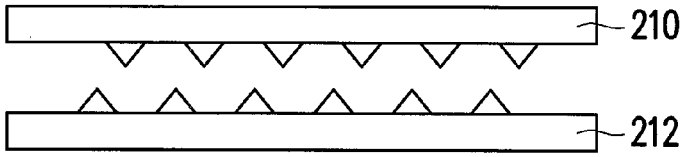
Figure 6C:
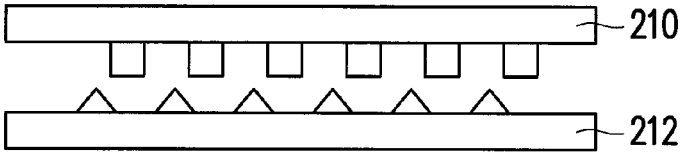
Figure 6D:
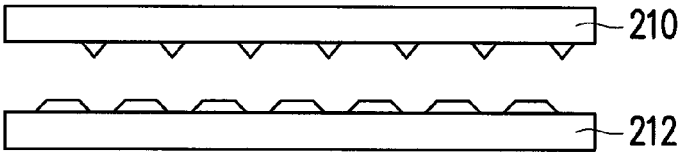
Figure 6E:
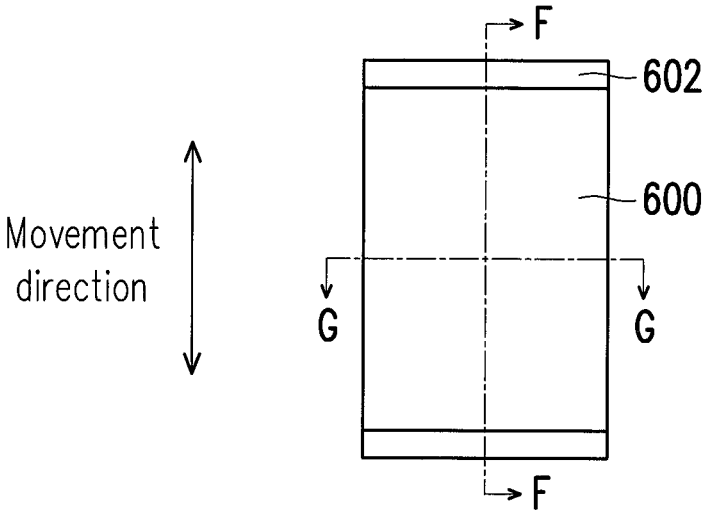
FIG. 6E shows a top view of the first and second contact layers of a component for fixing the curvature of a flexible device.
Figure 6F:
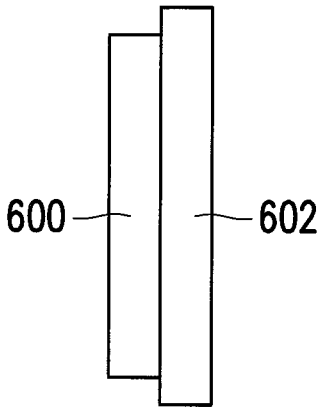
FIG. 6F is a cross-sectional diagram along line F-F of FIG. 6E.
Figure 6G:
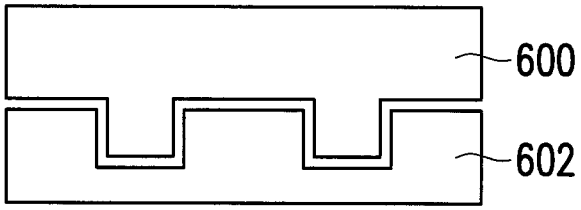
FIG. 6G is a cross-sectional diagram along line G-G of FIG. 6F.

Moreover, the dislocation direction or the space of magnetic repulsion of the first and second contact layers 210 and 212 shown in FIG. 2 may also be limited by providing a rail. FIG. 6E shows a top view of first and second contact layers 600 and 602 of a component for fixing the curvature of a flexible device, wherein a rail is provided such that the first and second contact layers 600 and 602 may move along the movement direction. FIG. 6F is a cross-sectional diagram along line F-F of FIG. 6E; FIG. 6G is a cross-sectional diagram along line G-G of FIG. 6E. A rail design having a concave side and a convex side may be observed in FIG. 6G.

Figure 7A:
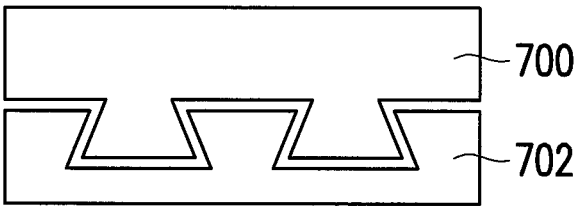
FIG. 7A and FIG. 7B are cross-sectional diagrams of other types of first and second contact layers having a rail.
Figure 7B:
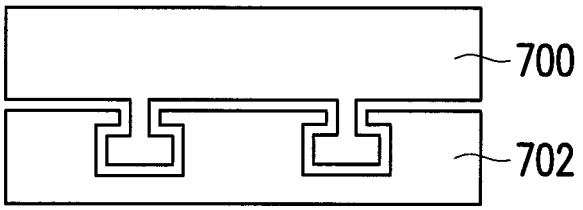

FIG. 7A and FIG. 7B are cross-sectional diagrams of other types of first and second contact layers having a rail. The contact surfaces between first and second contact layers 700 and 702 of the two rail designs may also be engaged with each other, and do not become completely separated when the permanent magnet substrate and the magnetic substrate are separated by repulsion.

In addition to the components shown in the embodiment of FIG. 2, the component for fixing the curvature of a flexible device of the disclosure may also have the following different configurations.

FIG. 8A to FIG. 8F are schematic diagrams of various components for fixing the curvature of a flexible device according to the second embodiment of the disclosure, wherein the same reference numerals as the first embodiment are used to represent the same or similar members.

Figure 8A:
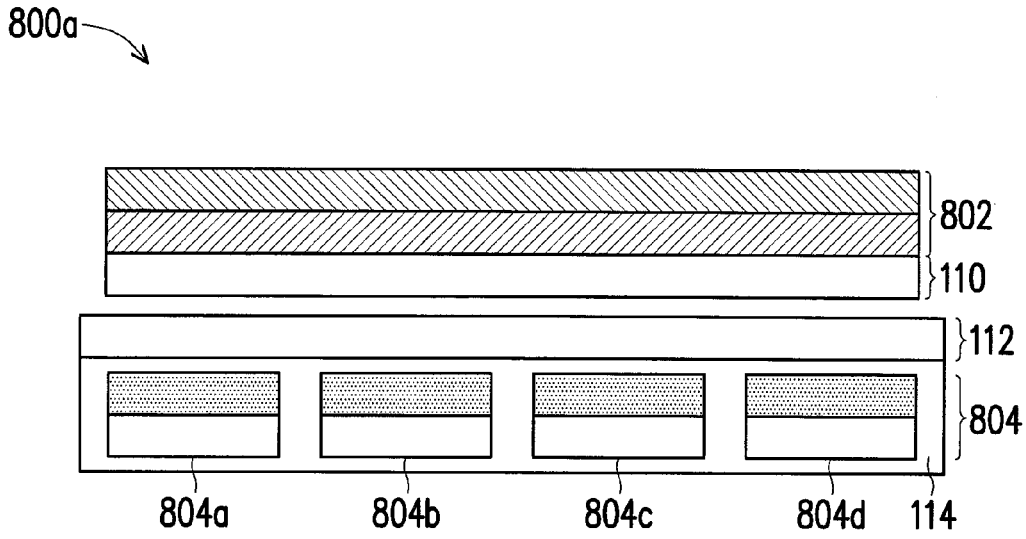
FIG. 8A to FIG. 8F are schematic diagrams of various components for fixing the curvature of a flexible device according to the second embodiment of the disclosure.

In FIG. 8A, a first permanent magnet substrate 802 of a component 800*a* for fixing the curvature of a flexible device is a single-layer structure while a magnetic substrate 804 is not a single layer of electromagnet structure as in FIG. 2 but an array formed by a plurality of single electromagnets (magnet components) 804*a-d*.

Figure 8B:
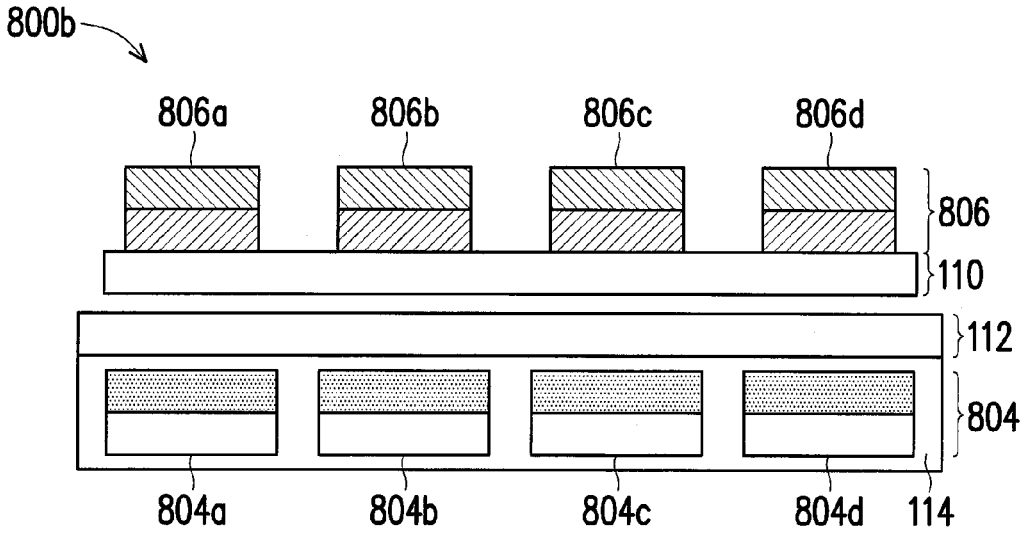

In FIG. 8B, a first permanent magnet substrate 806 of a component 800*b* for fixing the curvature of a flexible device is an array formed by a plurality of single permanent magnets 806*a-d*, and the magnetic substrate 804 is an array formed by the plurality of single electromagnets (magnet components) 804*a-d*. The array formed by the single permanent magnets 806*a-d* is correspondingly disposed to the array formed by the single electromagnets 804*a-d*.

Figure 8C:
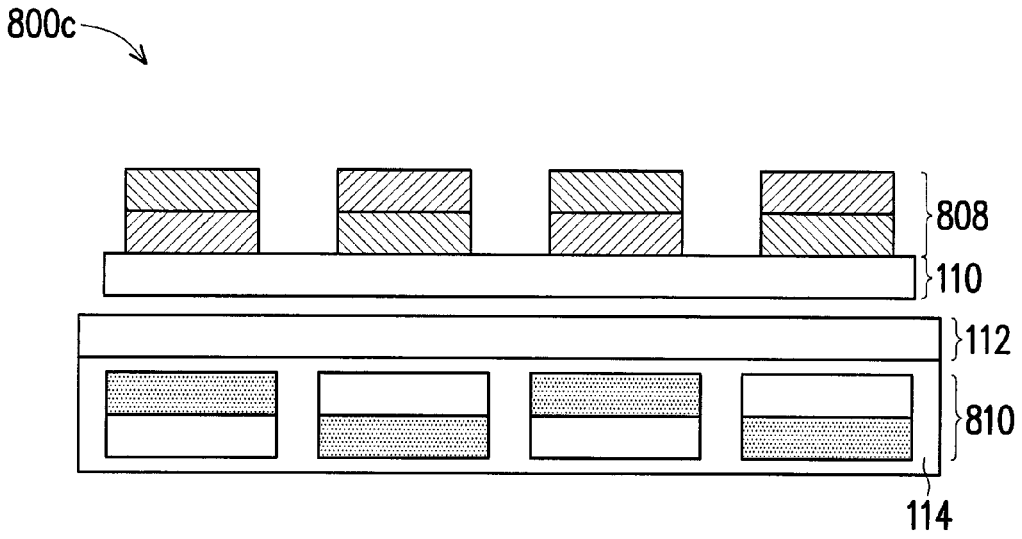

In FIG. 8C, a component 800*c* for fixing the curvature of a flexible device is similar to the component 800*b* for fixing the curvature of a flexible device, but adjacent permanent magnets in a first permanent magnet structure 808 have different polarity directions. Adjacent electromagnets in the magnetic substrate 810 also have different polarity directions when driven.

Figure 8D:
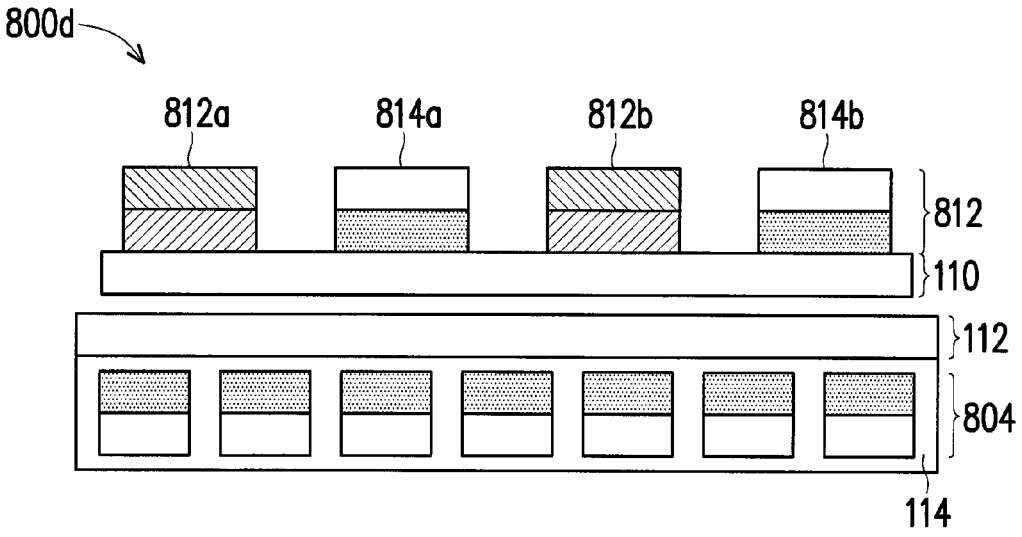

In FIG. 8D, in addition to an array formed by a plurality of single permanent magnets 812*a-b*, a first permanent magnet structure 812 of a component 800*d* for fixing the curvature of a flexible device also includes an array of electromagnets formed by electromagnets 814*a-b* and the electromagnets in the magnetic substrate 804.

Figure 8E:
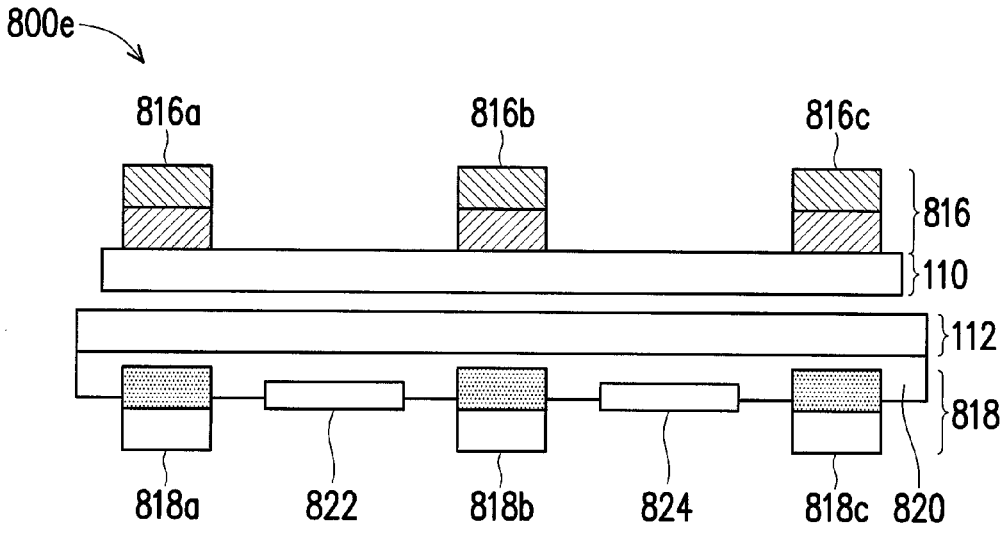

In FIG. 8E, a first permanent magnet structure 816 of a component 800*e* for fixing the curvature of a flexible device includes an array formed by a plurality of single permanent magnets 816*a-c*, and a magnetic substrate 818 is formed by a printed circuit board (PCB)/flexible printed circuit (FPC) board 820, electromagnets 818*a-c* disposed thereon, and other electronic components 822 and 824.

Figure 8F:
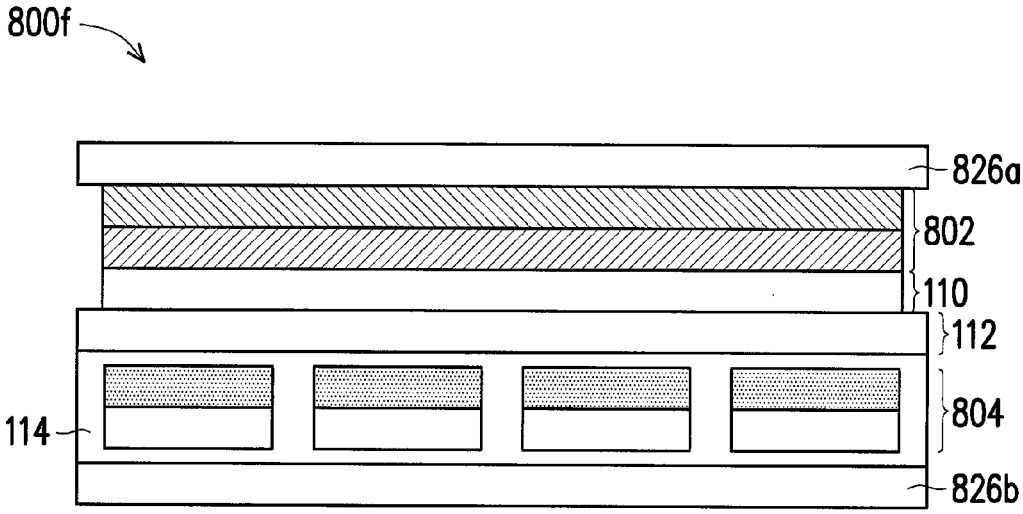

In FIG. 8F, an active deformation component 826*a* or 826*b* is added to one side of the permanent magnet substrate 802 or the magnetic substrate 804 of FIG. 8A for a component 800*f* for fixing the curvature of a flexible device, such as an electrically actuated component (such as an electroactive polymer (EAP) component, a vanadium dioxide component, an electronic muscle and so on) or a shape-memory material (such as a spring, a shape-memory alloy and so on).

Each figure above is an embodiment and the figures are only used to describe implementable examples of the disclosure and are not intended to limit the scope of the disclosure. For instance, each figure above is a cross-sectional diagram, and the array of magnetic components (such as the first permanent magnet structure, the electromagnet structure, the second permanent magnetic structure, or the ferromagnetic material structure) is not shown. Therefore, in actuality, the array of magnetic components capable of being applied to the permanent magnet substrate or the magnetic substrate of the embodiments of the disclosure is as shown in FIG. 9 or FIG. 10.

Figure 9:
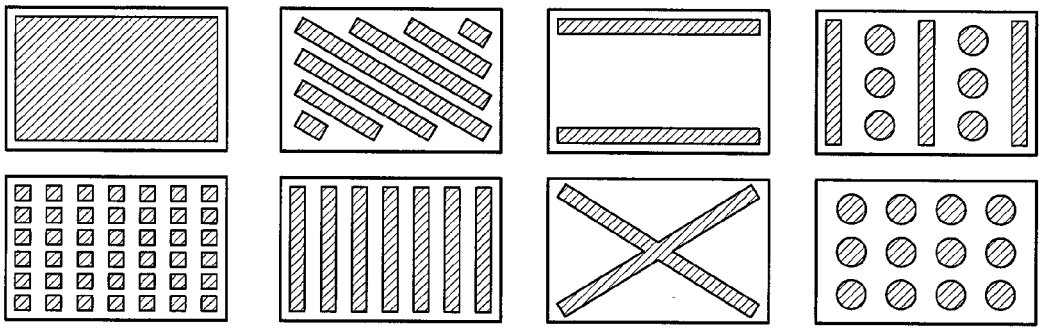
FIG. 9 shows a configuration diagram of various magnetic components.

FIG. 9 shows a configuration diagram of various magnetic components. In FIG. 9, each rectangle represents a top view of a permanent magnet substrate or a magnetic substrate of a component for fixing the curvature of a flexible device, wherein the diagonal draw patterns are arrays of magnetic components. The arrays of magnetic components on the permanent magnet substrate and the magnetic substrate do not need to correspond exactly. Provided the two substrates may be attached to each other, the locations of the magnetic components on the two substrates may be slightly shifted.

Figure 10:
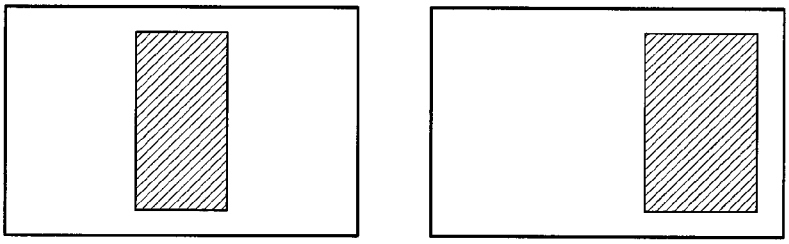
FIG. 10 shows a configuration diagram of various magnetic components implemented partially.

FIG. 10 is a configuration diagram of magnetic components implemented partially. In FIG. 10, each rectangle represents a top view of a permanent magnet substrate or a magnetic substrate of a component for fixing the curvature of a flexible device, wherein the diagonal draw patterns disposed only in the middle and on one side are arrays of magnetic components. The partially implemented magnetic components may be applied in a device that only needs to be partially bent or flexed.

Figure 11:
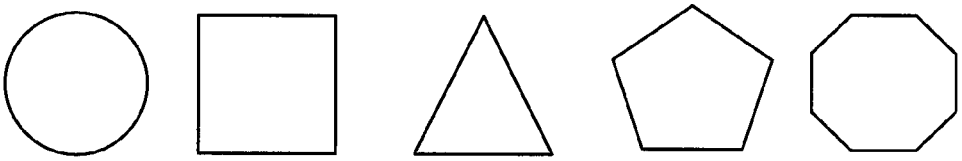
FIG. 11 is a schematic diagram of the shapes of various single magnetic components.

FIG. 11 is a schematic diagram of the shapes of various single magnetic components. Regardless of whether the single magnetic components are permanent magnet structures, electromagnet structures, or ferromagnetic material structures, the single magnetic components may be formed by the various shapes in FIG. 11, such as a circle, a rectangle, a triangle, a pentagon, or an octagon, but the disclosure is not limited thereto.

Figure 12A:
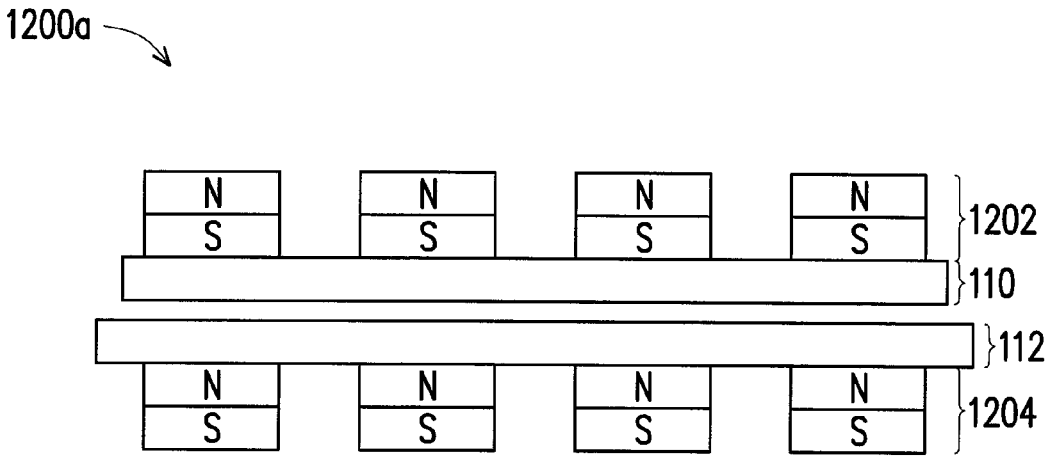
FIG. 12A and FIG. 12B are schematic diagrams of two components for fixing the curvature of a flexible device according to the third embodiment of the disclosure.
Figure 12B:
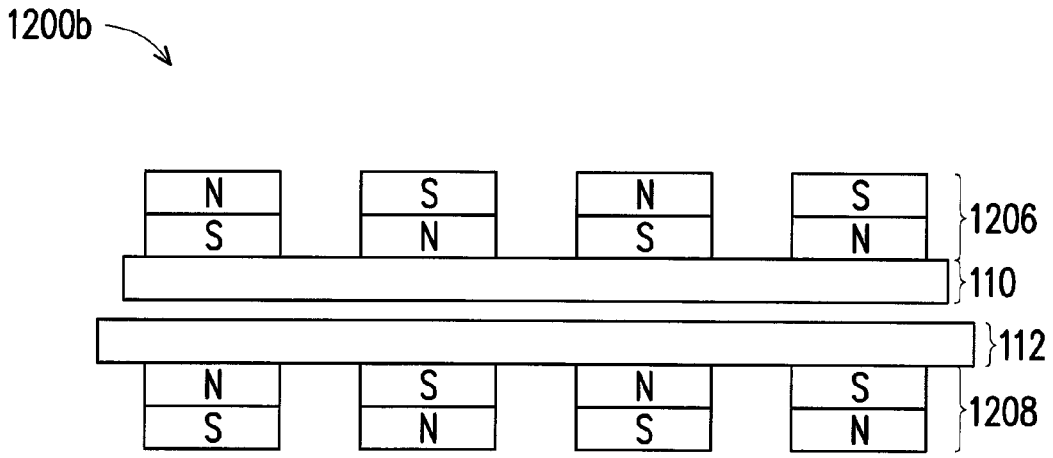

FIG. 12A to FIG. 12B are schematic diagrams of two components for fixing the curvature of a flexible device according to the third embodiment of the disclosure, wherein the same reference numerals as the first embodiment are used to represent the same or similar members.

In FIG. 12A, a component 1200*a* for fixing the curvature of a flexible device includes a permanent magnet substrate 1202 and another permanent magnet substrate 1204 connect to the permanent magnet substrate 1202. The permanent magnet substrate 1202 and the permanent magnet substrate 1204 are a first permanent magnet structure and a second permanent magnet structure formed by a plurality of single magnetic components. In the present embodiment, the rigidity of the first and second permanent magnet structures may be soft or rigid.

In FIG. 12B, similarly to the component 1200*a* for fixing the curvature of a flexible device in FIG. 12A, a component 1200*b* for fixing the curvature of a flexible device also includes two permanent magnet substrates, such as permanent magnet substrates 1206 and 1208 in FIG. 12B. However, the polarity locations of the permanent magnet substrates 1206 and 1208 are different from the polarity locations of the components in FIG. 12A.

The magnetic components (i.e., permanent magnets) of the third embodiment may be altered by referring to the examples of FIG. 9, FIG. 10, and FIG. 11, and are therefore not repeated herein.

Figure 13A:
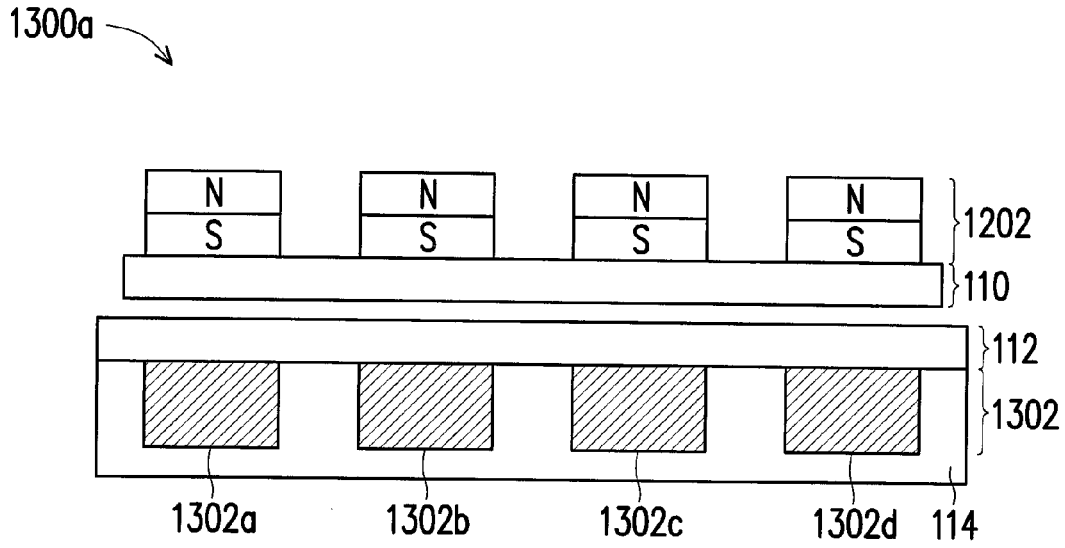
FIG. 13A and FIG. 13B are schematic diagrams of two components for fixing the curvature of a flexible device according to the fourth embodiment of the disclosure.
Figure 13B:
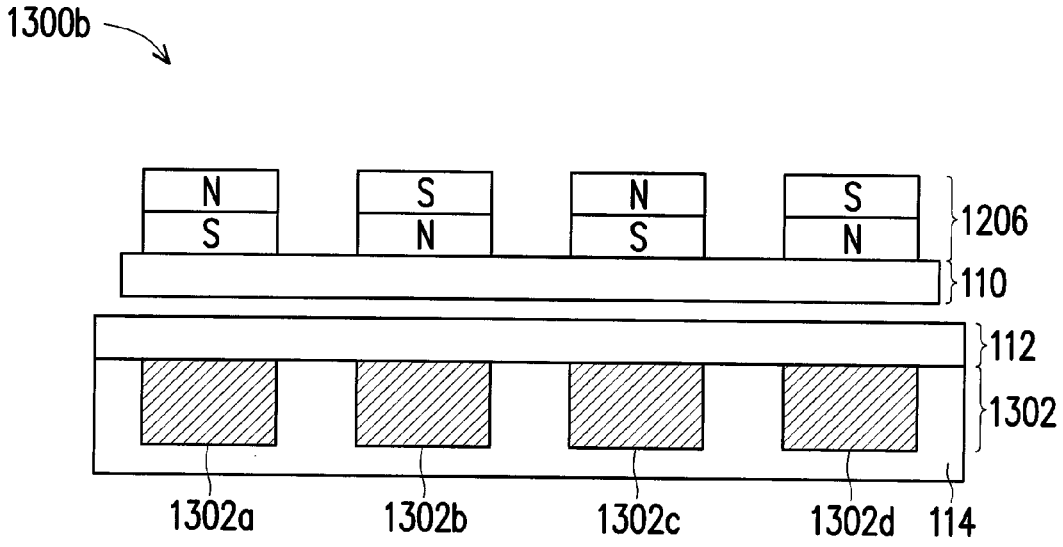

FIG. 13A and FIG. 13B are schematic diagrams of two components for fixing the curvature of a flexible device according to the fourth embodiment of the disclosure, wherein the same reference numerals as the third embodiment are used to represent the same or similar members.

In FIG. 13A, a component 1300*a* for fixing the curvature of a flexible device includes a permanent magnet substrate 1202 and a magnetic substrate 1302 connect to the permanent magnet substrate 1202. The magnetic substrate 1302 includes ferromagnetic material structures 1302*a-d* therein, wherein the ferromagnetic material structures 1302*a-d* are arrays formed by a plurality of single magnetic components. However, the disclosure is not limited thereto. The ferromagnetic material structures may also be single-layer structures.

In FIG. 13B, the difference between a component 1300*b* for fixing the curvature of a flexible device and the component 1300*a* for fixing the curvature of a flexible device is that the polarity location of the permanent magnet substrate 1206 therein is different. The rest are all as shown in FIG. 13A.

The magnetic components (i.e., ferromagnetic material structures) of the fourth embodiment may be altered by referring to the examples of FIG. 9, FIG. 10, and FIG. 11, and are therefore not repeated herein.

The component for fixing the curvature of a flexible device of each embodiment above may be applied in various flexible devices, flexible sensors, flexible fixing devices, or robots. The flexible device is, for instance, a flexible mobile phone, a personal digital assistant (PDA), a tablet computer, or a notebook computer. The flexible sensor is, for instance, a flexible X-ray, sensor or a flexible image sensor. The flexible fixing device is, for instance, an electronic bandage or a wristwatch.

Figure 14:
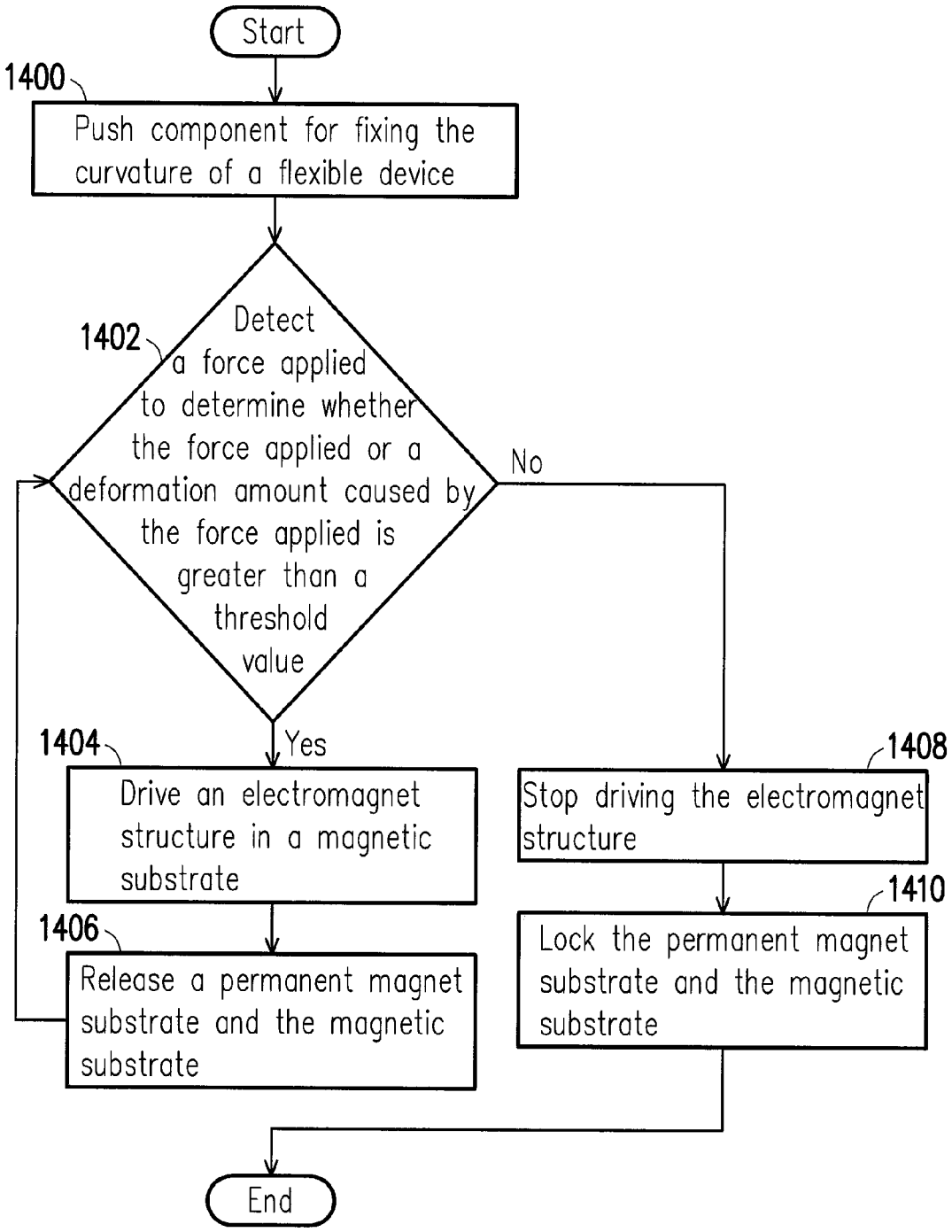
FIG. 14 is a step diagram of manual deformation and curvature fixing of a component for fixing the curvature of a flexible device according to the fifth embodiment of the disclosure.

FIG. 14 is a step diagram of manual deformation and curvature fixing of a component for fixing the curvature of a flexible device according to the fifth embodiment of the disclosure.

Referring to FIG. 14, in step 1400, a component for fixing the curvature of a flexible device is pushed, wherein the component for fixing the curvature of a flexible device may use the components mentioned in the first or second embodiment.

In step 1402, a force applied is detected to determine whether the force applied or the amount of deformation caused by the force applied is greater than a threshold value. If the force applied or the amount of deformation is greater than the threshold value, then step 1404 is performed. On the other hand, if the force applied or the amount of deformation is not greater than the threshold value, then step 1408 is performed. In the detecting step 1402, an acceleration sensor, a displacement sensor, a bending sensor, or a curved surface sensor may be used to perform sensing.

In step 1404, an electromagnet structure in a magnetic substrate is driven to release a permanent magnet substrate and the magnetic substrate in step 1406. The permanent magnet substrate and the magnetic substrate may be flexed at this point, and step 1402 of detecting thrust is repeated.

In step 1408, the driving of the electromagnet structure is stopped to lock the permanent magnet substrate and the magnetic substrate in step 1410.

Figure 15:
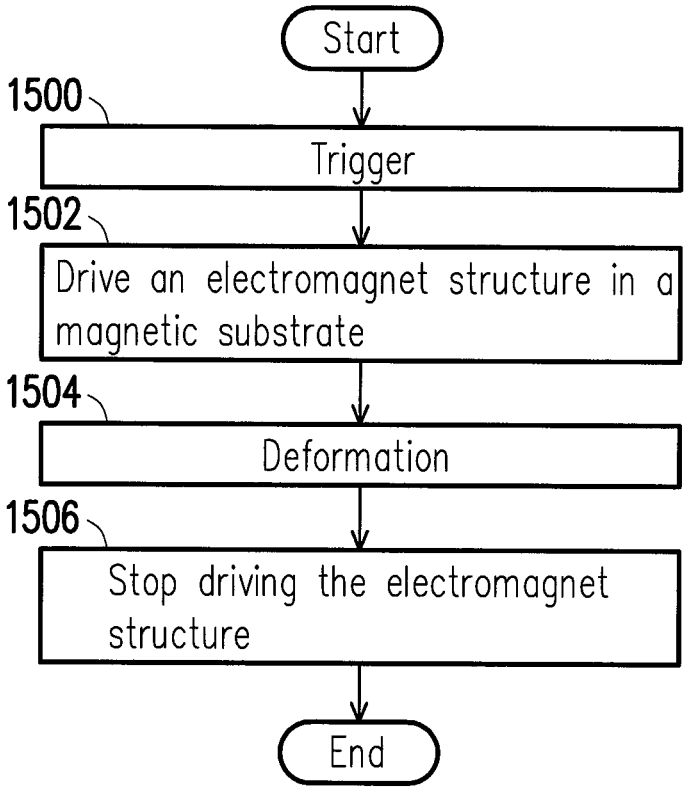
FIG. 15 is a step diagram of automatic deformation and curvature fixing of a component for fixing the curvature of a flexible device according to the sixth embodiment of the disclosure.

FIG. 15 is a step diagram of automatic deformation and curvature fixing of a component for fixing the curvature of a flexible device according to the sixth embodiment of the disclosure.

Referring to FIG. 15, in step 1500, a component for fixing the curvature of a flexible device is triggered, wherein the component for fixing the curvature of a flexible device may use the components mentioned in the first or second embodiment. The triggering step 1500 may include triggering via a program or triggering via a button.

In step 1502, an electromagnet structure in a magnetic substrate is driven to release a permanent magnet substrate and the magnetic substrate, and the electromagnet structure is driven through magnetic repulsion and attraction to generate dislocation displacement. Moreover, the structural design of the permanent magnet substrate or the magnetic substrate itself may be used such that the permanent magnet substrate or the magnetic substrate has a limited moving distance or space. Alternatively, an active deformation component (refer to 826*a* or 826*b* of FIG. 8F) such as an electrically actuated component (such as an EAP component, a vanadium dioxide component, or an electronic muscle) or a shape-memory material (such as a spring or a shape-memory alloy) may be used to automatically deform the component for fixing the curvature of a flexible device. Therefore, when the permanent magnet substrate and the magnetic substrate magnetically repel each other, the two may readily move relatively to each other and generate a fixed displacement to achieve the result of deformation (step 1504).

Then, in step 1506, the driving of the electromagnet structure is stopped to lock the permanent magnet substrate and the magnetic substrate. The locking may be started after a predetermined time after the driving step 1502 is started, and may also be started after a position sensor confirms the flexible device achieved a predetermined curvature after the driving step 1502 is started.

Figure 16:
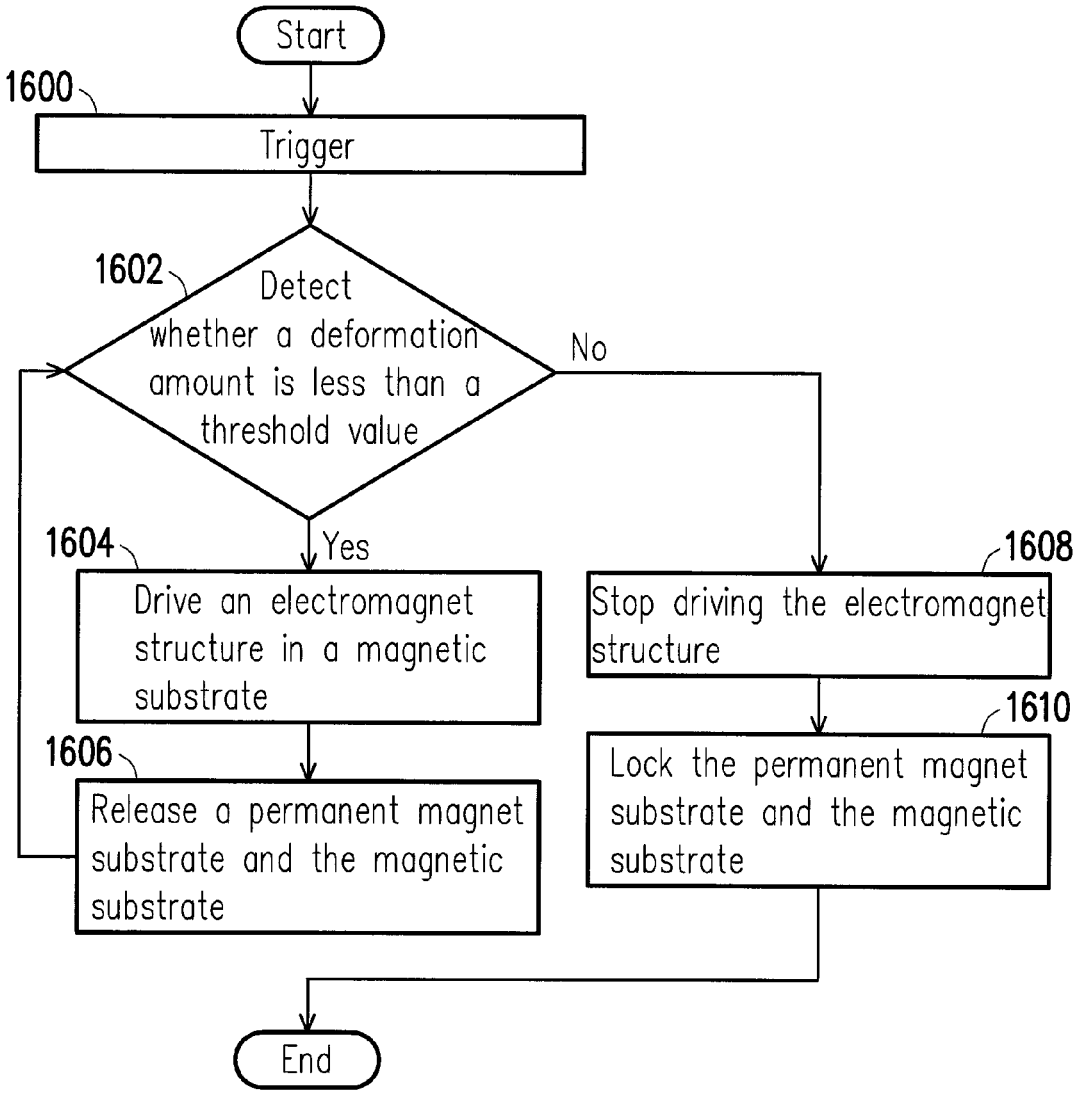
FIG. 16 is a step diagram of automatic deformation and curvature fixing of a component for fixing the curvature of a flexible device according to the seventh embodiment of the disclosure.

FIG. 16 is a step diagram of automatic deformation of a component for fixing the curvature of a flexible device according to the seventh embodiment of the disclosure.

Referring to FIG. 16, in step 1600, a component for fixing the curvature of a flexible device is triggered, wherein the component for fixing the curvature of a flexible device may use the components mentioned in the first or second embodiment. The triggering step 1600 may include triggering via a program or triggering via a button.

In step 1602, the amount of deformation is detected to determine whether the amount of deformation is less than a threshold value. If the amount of deformation is less than the threshold value, then step 1604 is performed; on the other hand, if the amount of deformation is not less than the threshold value, then step 1608 is performed. In the detecting step

1602, an acceleration sensor, a displacement sensor, a bending sensor, or a curved surface sensor may be used to perform sensing.

In step 1604, an electromagnet structure in the magnetic substrate is driven to release a permanent magnet substrate and the magnetic substrate in step 1606. The permanent magnet substrate and the magnetic substrate may be flexed at this point, and step 1602 of detecting deformation is repeated.

In step 1608, the driving of the electromagnet structure is stopped so as to lock the permanent magnet substrate and the magnetic substrate in step 1610.

Based on the above, in the disclosure, a permanent magnet substrate and another flexible magnetic component may be controlled such that dislocation is generated between the flexing interfaces between the two magnetic substrates to fix the two magnetic substrates. As a result, the flexible device may be readily changed and the flexing curvature thereof may be fixed. Moreover, power does not need to be continuously supplied.

Although the disclosure has been described with reference to the above embodiments, it will be apparent to one of the ordinary skill in the art that modifications to the described embodiments may be made without departing from the spirit of the disclosure. Accordingly, the scope of the disclosure is defined by the attached claims not by the above detailed descriptions.

What is claimed is:

1. A component for fixing a curvature of a flexible device, comprising:

a permanent magnet substrate comprising a first permanent magnet structure; and a magnetic substrate connects to the permanent magnet substrate, wherein the magnetic substrate comprises an electromagnet structure, a second permanent magnet structure, or a ferromagnetic material structure, and both the permanent magnet substrate and the magnetic substrate are deformable or flexible through dislocation displacement caused by magnetic repulsion and attraction.

2. The component for fixing a curvature of a flexible device of claim 1, further comprising:

a first contact layer between the permanent magnet substrate and the magnetic substrate, wherein the first contact layer is disposed on the permanent magnet substrate; and a second contact layer between the first contact layer and the magnetic substrate, wherein the second contact layer is disposed on the magnetic substrate.

3. The component for fixing a curvature of a flexible device of claim 2, wherein a surface of the first contact layer contacted to the second contact layer comprises a roughened surface, a zigzag surface, a three-dimensional pattern, or an array thereof.

4. The component for fixing a curvature of a flexible device of claim 2, wherein a surface of the second contact layer contacted to the first contact layer comprises a roughened surface, a zigzag surface, a three-dimensional pattern, or an array thereof.

5. The component for fixing a curvature of a flexible device of claim 2, wherein contact surfaces between the first contact layer and the second contact layer are engaged with each other.

6. The component for fixing a curvature of a flexible device of claim 1, further comprising a driving circuit linked to the electromagnet structure to lock or release the permanent magnet substrate and the magnetic substrate.

7. The component for fixing a curvature of a flexible device of claim 1, wherein the electromagnet structure, the second permanent magnet structure, or the ferromagnetic material structure comprises a single-layer structure or an array formed by a plurality of single magnetic components.

8. The component for fixing a curvature of a flexible device of claim 1, wherein a rigidity of the first or second permanent magnet structure comprises soft or rigid.

9. The component for fixing a curvature of a flexible device of claim 1, wherein the first or second permanent magnet structure comprises a single-layer structure or is formed by a plurality of permanent magnets.

10. The component for fixing a curvature of a flexible device of claim 1, wherein the electromagnet structure, the second permanent magnet structure, or the ferromagnetic material structure in the magnetic substrate is a patterned structure having a corresponding relationship with the first permanent magnet structure.

11. The component for fixing a curvature of a flexible device of claim 1, wherein the permanent magnet substrate further comprises a plurality of electromagnets therein, and the electromagnets and the electromagnet structure in the magnetic substrate form an array.

12. The component for fixing a curvature of a flexible device of claim 1, further comprising an active deformation component located on one side of the permanent magnet substrate or the magnetic substrate.

13. The component for fixing a curvature of a flexible device of claim 12, wherein the active deformation component comprises an electrically actuated component or a shape-memory material.

14. The component for fixing a curvature of a flexible device of claim 13, wherein the electrically actuated component comprises an electroactive polymer (EAP) component, a vanadium dioxide component, or an electronic muscle.

15. The component for fixing a curvature of a flexible device of claim 13, wherein the shape-memory material comprises a spring or a shape-memory alloy.

16. A manual deformation and fixing curvature method of the component of claim 1, comprising:

pushing the component for fixing a curvature of a flexible device;

detecting a force applied and determining whether the force applied or an amount of deformation caused by the force applied is greater than a threshold value;

driving the electromagnet structure in the magnetic substrate to release the permanent magnet substrate and the magnetic substrate if the force applied or the amount of deformation is greater than the threshold value, and detecting the force applied or the amount of deformation repeatedly; and stopping driving the electromagnet structure to lock the permanent magnet substrate and the magnetic substrate if the force applied or the amount of deformation is not greater than the threshold value.

17. The method of claim 16, wherein a step of the detecting comprises using an acceleration sensor, a displacement sensor, a bending sensor, or a curved surface sensor.

18. An automatic deformation and fixing curvature method of the component of claim 1, comprising:

triggering the component for fixing the curvature of the flexible device;

driving the electromagnet structure in the magnetic substrate to release the permanent magnet substrate and the magnetic substrate and drive the electromagnet structure through magnetic repulsion and attraction so as to generate dislocation displacement;

deforming the component for fixing the curvature of the flexible device; and stopping diving the electromagnet structure to lock the permanent magnet substrate and the magnetic substrate.

19. The method of claim 18, wherein a step of the triggering comprises triggering via a program or triggering via a button.

20. An automatic deformation and fixing curvature method of the component of claim 1, comprising:

triggering the component for fixing the curvature of the flexible device;

detecting a deformation of the component for fixing the curvature of the flexible device to determine whether the deformation is less than a threshold value;

driving an electromagnet structure in a magnetic substrate to release the permanent magnet substrate and the magnetic substrate if the deformation is less than the threshold value, and detecting the deformation repeatedly; and stopping driving the electromagnet structure to lock the permanent magnet substrate and the magnetic substrate if the deformation is not less than the threshold value.

21. The method of claim 20, wherein a step of the triggering comprises triggering via a program or triggering via a button.

22. The method of claim 20, wherein a step of the detecting comprises using an acceleration sensor, a displacement sensor, a bending sensor, or a curved surface sensor.

23. A component for fixing a curvature of a flexible device, comprising:

a permanent magnet substrate comprising a first permanent magnet structure; and a magnetic substrate connects to the permanent magnet substrate, wherein the magnetic substrate comprises an electromagnet structure, a second permanent magnet structure, or a ferromagnetic material structure, and both the permanent magnet substrate and the magnetic substrate are deformable or flexible through dislocation displacement caused by magnetic repulsion and attraction, wherein the curvature of the flexible device is determined by a relative position between the first permanent magnet structure and the magnetic substrate.

* * * * *